US007038568B2

(12) United States Patent
Kaneko et al.

(10) Patent No.: US 7,038,568 B2
(45) Date of Patent: May 2, 2006

(54) REACTOR UNIT

(75) Inventors: Masaaki Kaneko, Kariya (JP); Hitoshi Sato, Kagamihara (JP)

(73) Assignees: Toyota Jidosha Kabushiki Kaisha, Toyota (JP); Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/660,603

(22) Filed: Sep. 12, 2003

(65) Prior Publication Data

US 2004/0056747 A1 Mar. 25, 2004

(30) Foreign Application Priority Data

Sep. 25, 2002 (JP) ..... 2002-279431

(51) Int. Cl.
*H01F 27/02* (2006.01)

(52) U.S. Cl. ..... 336/83; 336/90; 336/96

(58) Field of Classification Search ..... 336/83, 336/90–98, 192, 198
See application file for complete search history.

(56) References Cited

U.S. PATENT DOCUMENTS 3,778,529 A 12/1973 Miller
4,109,223 A 8/1978 Tenkman et al.
5,109,209 A * 4/1992 Ida et al. ..... 336/96
5,444,427 A * 8/1995 Ida et al. ..... 336/198
6,496,090 B1 * 12/2002 Nishida et al. ..... 335/202
6,556,118 B1 * 4/2003 Skinner ..... 336/182

FOREIGN PATENT DOCUMENTS

FR 2 771 842 A1 6/1999
JP 4-133486 A 12/1992
JP 5-109542 A 4/1993

* cited by examiner

*Primary Examiner*—Lincoln Donovan
(74) *Attorney, Agent, or Firm*—Kenyon & Kenyon LLP

(57) ABSTRACT

A reactor unit comprises a basket body, a plurality of reactor bodies, a lid body, and a mold resin. The basket body has one open face and is made of a metal. The reactor bodies are accommodated in the basket body. The lid body is made of a metal and closes an open end of the basket body. Outlet holes are formed in the lid body. The mold resin is a curable resin. The basket body is filled with the mold resin, with a coil of each of the reactor bodies having been drawn out from a corresponding one of the outlet holes of the lid body. In this reactor unit, at least one partition, which is located between the reactor bodies and whose leading end extends from an inner face of at least one of the basket body and the lid body and abuts on an inner face of the other, is formed protrusively.

10 Claims, 4 Drawing Sheets

REACTOR UNIT

INCORPORATION BY REFERENCE

The disclosure of Japanese Patent Application No. 2002-279431 filed on Sep. 25, 2002, including the specification, drawings, and abstract is incorporated herein by reference in its entirety.

BACKGROUND OF THE INVENTION

1. Field of the Invention

The invention relates to a reactor unit whose reactor bodies can be cooled efficiently.

2. Description of the Related Art

Heretofore, there has been known a reactor unit whose smoothing reactors, which are used for an electric power converter, for example, a converter, an inverter or the like, can be cooled efficiently. For instance, such a reactor unit is disclosed in Paragraph 0007 and FIGS. 1 and 2 of Japanese Patent Application Laid-Open No. 5-109542.

In the reactor unit disclosed in Japanese Patent Application Laid-Open No. 5-109542, reactor bodies, each of which is constructed by winding a pair of coils around an iron core, are accommodated in a metal box-type case exhibiting a high thermal conductivity, and a space formed in the case is filled with a resin insulant exhibiting a high thermal conductivity.

A curable resin such as epoxy resin or the like is used as the resin insulant that is high in thermal conductivity. Shrinkage or the like of the resin occurring during curing thereof causes problems. That is, the resin insulant in the metal box-type case is detached from an inner face thereof, and the metal box-type case undergoes deformation such as distortion or the like.

Hence, in order to prevent such detachment or deformation, there has been known another technology. According to this technology, a basket body made of a metal and having one open face, reactor bodies accommodated in the basket body, a lid body made of a metal and closing an open end of the basket body, and a curable mold resin filling the interior of the basket body are provided. Eight spaces to be filled with the mold resin are formed between the reactor bodies and the lid body. These spaces are separated from one another by a pair of cruciform spacers and a plate-type spacer located between the cruciform spacers. The spaces thus defined serve to reduce shrinkage ratio of the mold resin. For instance, such a technology is disclosed in Paragraph 0007 and FIGS. 1 and 2 of Japanese Utility Model Application Laid-Open No. 4-133486.

A reactor unit constructed as described above and disclosed in Japanese Utility Model Application Laid-Open No. 4-133486 serves only to reduce shrinkage ratio of the mold resin and cannot suppress shrinkage thereof sufficiently. In particular, the lid body is designed simply as a plate and thus cannot be prevented from being deformed.

SUMMARY OF THE INVENTION

In order to solve the problems stated above, the invention provides, as an exemplary embodiment thereof, a reactor unit which can be prevented from being deformed due to shrinkage of a mold resin occurring during curing thereof.

First of all, therefore, there is provided a reactor unit comprising a basket body, a plurality of reactor bodies, a lid body, and a mold resin. The basket body has one open face and is made of a metal. The reactor bodies are accommodated in the basket body. The lid body is made of a metal and closes an open end of the basket body. Outlet holes are formed in the lid body. The mold resin is a curable resin. The basket body is filled with the mold resin, with a coil of each of the reactor bodies having been drawn out from a corresponding one of the outlet holes of the lid body. This reactor unit is characterized in that at least one partition, which is located between the reactor bodies and whose leading end extends from an inner face of at least one of the basket body and the lid body and abuts on an inner face of the other, is formed protrusively.

According to the reactor unit thus constructed, the basket body made of the metal has one open face, and the open end of the basket body is closed by the lid body made of the metal. The partition, whose leading end extends from the inner face of one of the basket body and the lid body and abuts on the inner face of the other, is formed protrusively. The reactor bodies are accommodated in the basket body such that the partition is located between the reactor bodies. The basket body is filled with the curable mold resin, with the coil of each of the reactor bodies having been drawn out from a corresponding one of the outlet holes formed in the lid body.

Thus, even if the mold resin filling the interior of the basket body has shrunk while curing, the lid body can be prevented from being deformed because the inner face of the lid body abuts on and is supported by the partition.

BRIEF DESCRIPTION OF THE DRAWINGS

The above-mentioned construction and other constructions, objects, features, advantages, technical and industrial significance of this invention will be better understood by reading the following detailed description of the exemplary embodiments of the invention, when considered in connection with the accompanying drawings, in which.

DESCRIPTION OF THE EXEMPLARY EMBODIMENTS

In the following description and the accompanying drawings, the invention will be described in more detail in terms of exemplary embodiments thereof.

(First Embodiment)

Figure 1A:
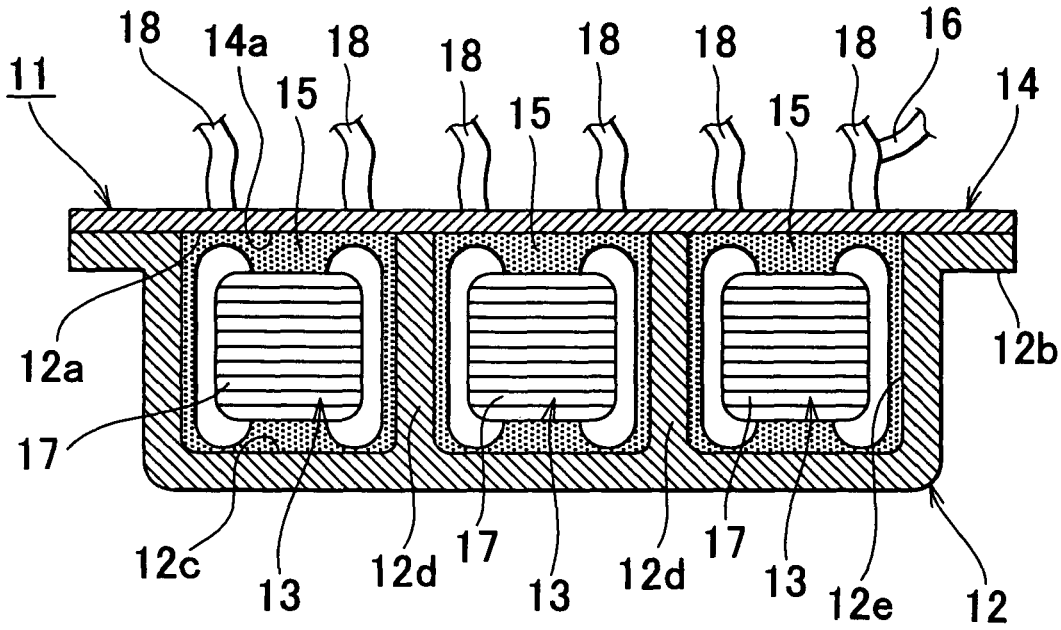
FIG. 1A is a frontal longitudinal sectional view of a reactor unit in accordance with a first embodiment of the invention.
Figure 1B:
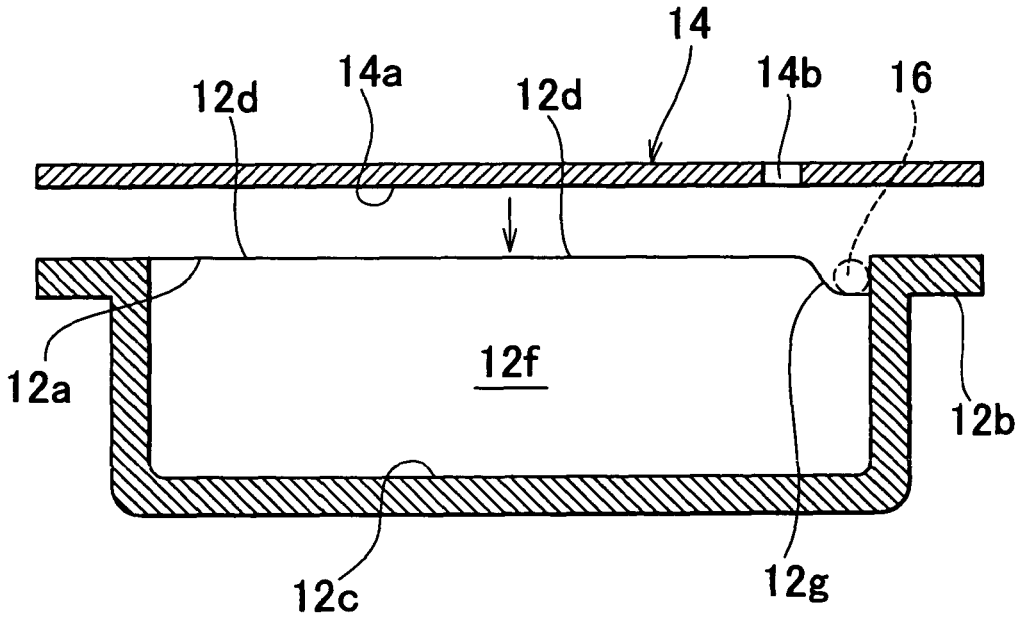
FIG. 1B is a lateral longitudinal sectional view of the reactor unit in accordance with the first embodiment of the invention.

FIGS. 1A and 1B illustrate a reactor unit in accordance with the first embodiment of the invention. FIG. 1A is a frontal longitudinal sectional view of the reactor unit. FIG.

Figure 2:
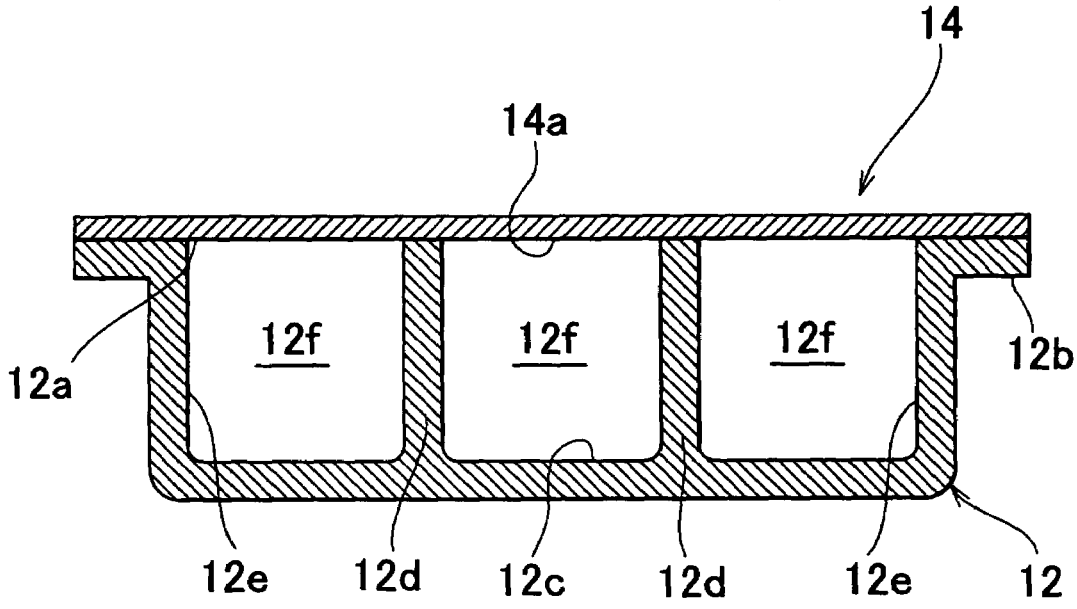
FIG. 2 is a frontal sectional view which illustrates how a basket body and a lid body of the reactor unit in accordance with the first embodiment of the invention are related to each other.

1B is a lateral longitudinal sectional view of the reactor unit. FIG. 2 is a frontal sectional view illustrating how a basket body and a lid body of the reactor unit are related to each other.

Referring to FIGS. 1A, 1B, and 2, a reactor unit 11 includes a basket body 12 made of a metal exhibiting a relatively high thermal conductivity, for example, of aluminum or the like, a plurality of reactor bodies 13 accommodated in the basket body 12, a plate-type lid body 14 made of a metal exhibiting a relatively high thermal conductivity, for example, of aluminum or the like, and a curable mold resin 15 with which the basket body 12 is filled.

The basket body 12 has one open face. An open end 12*a* of the basket body 12 is closed by the lid body 14. A brim-type flange 12*b* for fixing the lid body 14 is integrated with the basket body 12. Two partitions 12*d* formed as rising walls are integrated with the basket body 12 in such a manner as to protrude from an inner bottom face (inner face) thereof.

Leading ends of the partitions 12*d* are extended so far as to abut on a bottom face (inner face) 14*a* of the lid body 14 when the open end 12*a* is closed by the lid body 14. The partitions 12*d* cooperate with a wall face 12*e* to form three accommodation spaces 12*f* into which the interior of the basket body 12 is equally divided. The wall face 12*e* faces the partitions 12*d* of the basket body 12. In addition, a notch 12*g* is formed in each of the partitions 12*d* at a position close to the open end 12*a*. A wire 16 for a temperature detector (not shown) provided in the basket body 12 is located in the notch 12*g*. The temperature detector is provided to detect a temperature of each of the reactor bodies 13. A thermistor or the like is employed as the temperature detector.

Each of the reactor bodies 13 includes an iron core 17 and a pair of coils 18 wound around the iron core 17. Crimp contacts (not shown) are fitted to leading ends of the coils 18.

Outlet holes 14*b* are formed in the lid body 14. An end of each of the coils 18 passes through a corresponding one of the outlet holes 14*b*. The wire 16, which is extended from the aforementioned temperature detector and which is so disposed as to pass through the notch 12*g* of a corresponding one of the partitions 12*d*, is drawn out from one of the outlet holes 14*b*.

A curable resin exhibiting insulating properties, for example, epoxy resin or the like is employed as the mold resin 15. Each of the accommodation spaces 12*f* is filled with the mold resin 15 flowing from a corresponding one of the outlet holes 14*b*, such that the mold resin 15 surrounds each of the reactor bodies 13 accommodated in a corresponding one of the accommodation spaces 12*f*. In this case, a surplus of the mold resin 15, which results from differences among amounts of the mold resin 15 with which the accommodation spaces 12*f* are filled, is supplied to an adjacent one of the accommodation spaces 12*f* from a gap formed between the notch 12*g* and the wire 16. As a result, the mold resin 15 can be supplied to the accommodation spaces 12*f* homogeneously.

In the aforementioned construction, the reactor unit 11 has the reactor bodies 13 accommodated in the accommodation spaces 12*f* of the basket body 12 respectively. After the temperature detector has been accommodated in an arbitrary (preferably central) one of the accommodation spaces 12*f*, the end of each of the coils 18 of each of the reactor bodies 13 is drawn out from a corresponding one of the outlet holes 14*b* of the lid body 14. While being so disposed as to extend along the notch 12*g*, the wire 16 is drawn out from a corresponding one of the outlet holes 14*b*.

In this state, while the coils 18 and the wire 16 that have been drawn out from the outlet holes 14*b* are maintained in a suitably strained state, the open end 12*a* is closed by the lid body 14. Then, the mold resin 15 is fed from each of the outlet holes 14*b* (or an arbitrary one of the outlet holes 14*b*).

The mold resin 15 is thereafter cured. Because of a reduction in volume resulting from division of the interior of the basket body 12 into the accommodation spaces 12*f* and abutment of the leading ends of the partitions 12*d* on the bottom face 14*a* of the lid body 14, shrinkage of the mold resin 15 occurring during curing thereof does not lead to deformation of the lid body 14.

Further, since the partitions 12*d* are integrated with the basket body 12, the basket body 12 can also be prevented from being deformed.

(Second Embodiment)

Figure 3A:
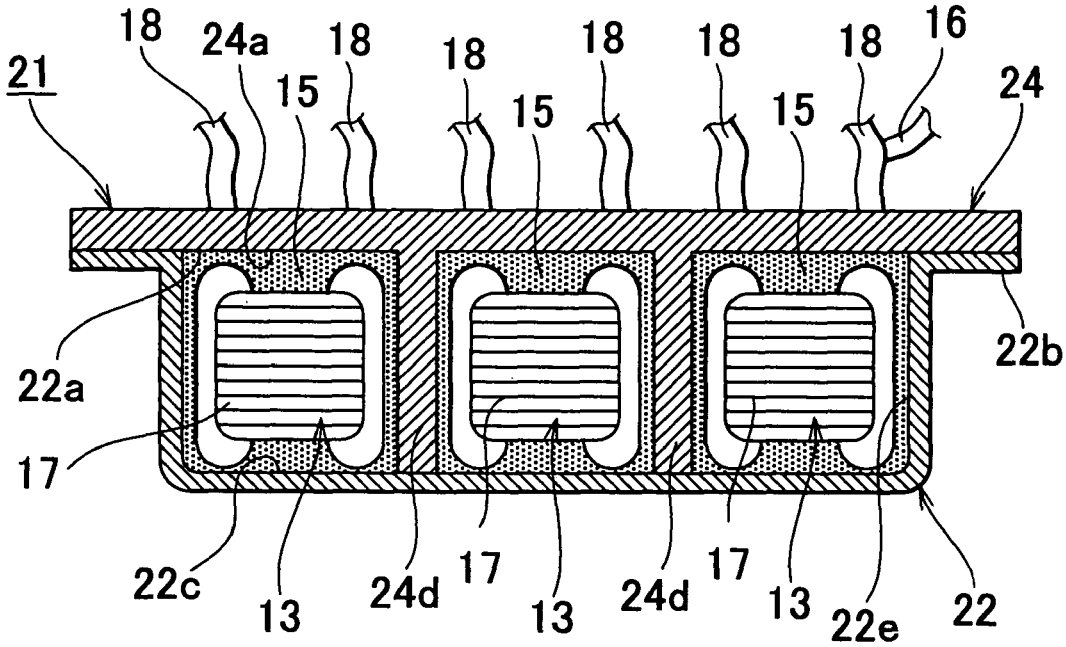
FIG. 3A is a frontal longitudinal sectional view of a reactor unit in accordance with a second embodiment of the invention.
Figure 3B:
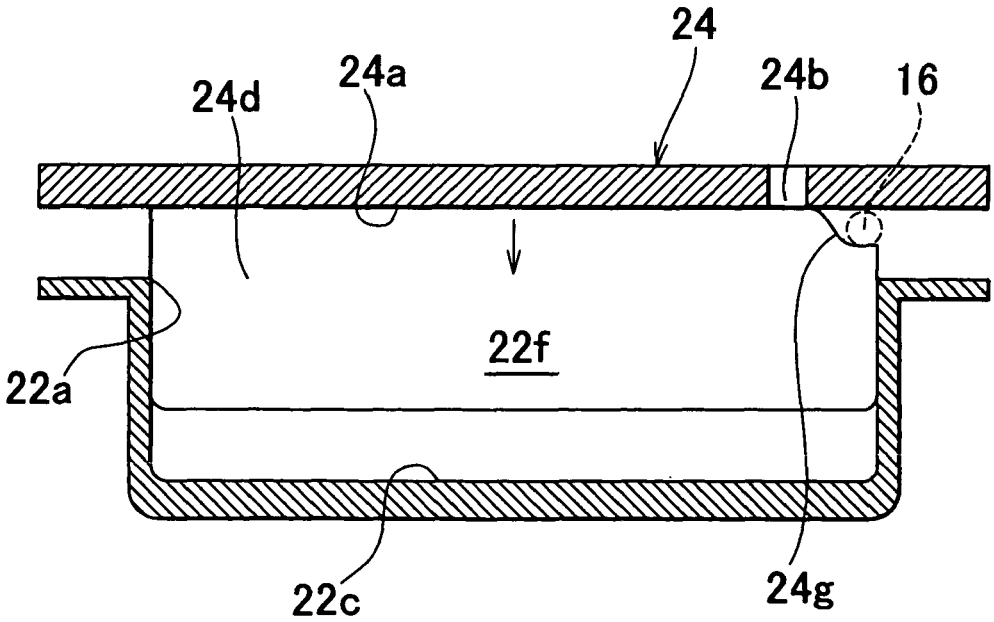
FIG. 3B is a lateral longitudinal sectional view of the reactor unit in accordance with the second embodiment of the invention.
Figure 4:
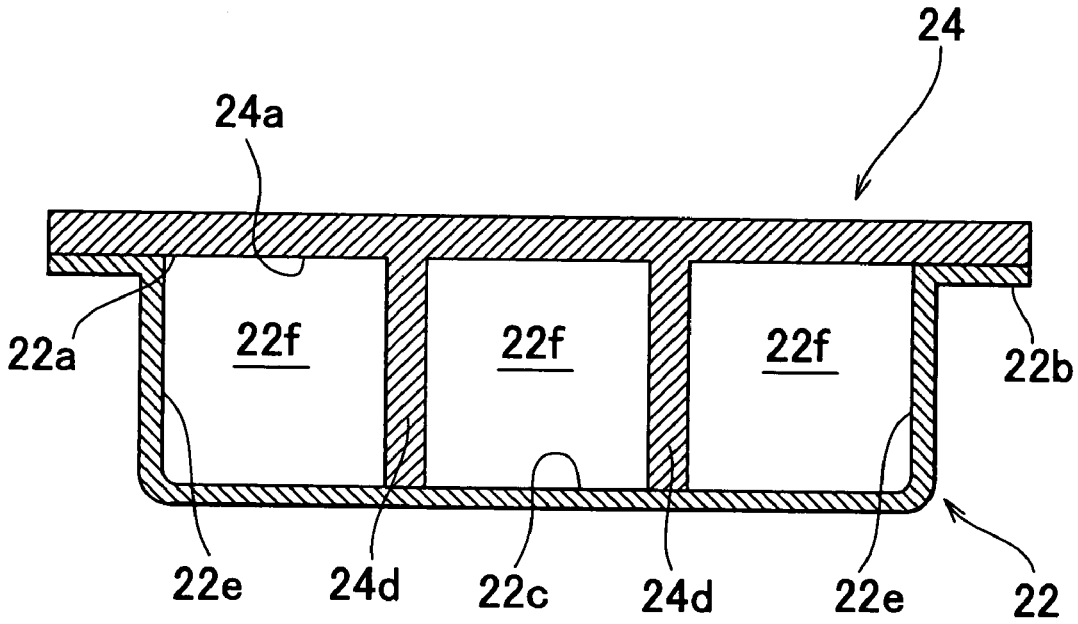
FIG. 4 is a frontal sectional view which illustrates how a basket body and a lid body of the reactor unit in accordance with the second embodiment of the invention are related to each other.

FIGS. 3A and 3B illustrate a reactor unit in accordance with the second embodiment of the invention. FIG. 3A is a frontal longitudinal sectional view of the reactor unit. FIG. 3B is a lateral longitudinal sectional view of the reactor unit. FIG. 4 is a frontal sectional view illustrating how a basket body and a lid body of the reactor unit are related to each other.

Referring to FIGS. 3A, 3B, and 4, a reactor unit 21 includes a basket body 22 made of a metal exhibiting a relatively high thermal conductivity, for example, of aluminum or the like, the reactor bodies 13 accommodated in the basket body 22, a plate-type lid body 24 made of a metal exhibiting a relatively high thermal conductivity, for example, of aluminum or the like, and the curable mold resin 15 with which the basket body 22 is filled.

The basket body 22 has one open face. An open end 22*a* of the basket body 22 is closed by the lid body 24. The basket body 22 has a brim-type flange 22*b* for fixing the lid body 24.

Partitions 24*d* are integrated with a bottom face (inner face) 24*a* of the lid body 24 in such a manner as to protrude therefrom. When the open end 22*a* is closed by the lid body 24, the partitions 24*d* abut on a bottom face (inner face) 22*c* of the basket body 22. Outlet holes 24*b* are formed in the lid body 24. An end of each of the coils 18 passes through a corresponding one of the outlet holes 24*b*.

The wire 16 for a temperature detector (not shown) provided in the basket body 22 is drawn out from one of the outlet holes 24*b*. The wire 16 is so disposed as to pass through a notch 24*g* formed in each of the partitions 24*d* at a position close to the bottom face 24*a*. The temperature detector is provided to detect a temperature of each of the reactor bodies 13. A thermistor or the like is employed as the temperature detector.

Each of the accommodation spaces 22*f* is filled with the mold resin 15 flowing from a corresponding one of the outlet holes 24*b*, such that the mold resin 15 surrounds each of the reactor bodies 13 accommodated in a corresponding one of the accommodation spaces 22*f*. In this case, a surplus of the mold resin 15, which results from differences among amounts of the mold resin 15 with which the accommodation spaces 22*f* are filled, is supplied to an adjacent one of the accommodation spaces 22*f* from a gap formed between the notch 24*g* and the wire 16. As a result, the mold resin 15 can be supplied to the accommodation spaces 22*f* homogeneously.

In the aforementioned construction, the reactor unit 21 has the reactor bodies 13 accommodated at suitable locations of the basket body 22. After the temperature detector has been accommodated in an arbitrary (preferably central) one of the accommodation spaces 22*f*, the end of each of the coils 18 of each of the reactor bodies 13 is drawn out from a corresponding one of the outlet holes 24*b* of the lid body 24. While being so disposed as to extend along the notch 24*g*, the wire 16 is drawn out from a corresponding one of the outlet holes 24*b*.

In this state, while the coils 18 and the wire 16 that have been drawn out from the outlet holes 24*b* are maintained in a suitably strained state, the open end 22*a* is closed by the lid body 24. Then, the mold resin 15 is fed from each of the outlet holes 24*b* (or an arbitrary one of the outlet holes 24*b*).

The mold resin 15 is thereafter cured. Because of a reduction in volume resulting from division of the interior of the basket body 22 into the accommodation spaces 22*f* and abutment of the leading ends of the partitions 24*d* on the bottom face 22*c* of the basket body 22, shrinkage of the mold resin 15 occurring during curing thereof does not lead to deformation of the lid body 24.

In each of the aforementioned first and second embodiments, each of the reactor bodies 13 is spaced from a corresponding one of the partitions 12*d* or 24*d* (and the wall face 12*e* of the basket body 12 or a wall face 22*e* of the basket body 22) by a gap. However, each of the reactor bodies 13 may be disposed with this gap being eliminated. That is, the gap between each of the reactor bodies 13 and the wall face of a corresponding one of the partitions 12*d* or 24*d* (and the wall face 12*e* or 22*e* of the basket body 12 or 22) may be filled with the mold resin.

In such a case, therefore, according to an assembly procedure of the first embodiment for example, while the reactor bodies 13 are accommodated on the side of the basket body 12, the open end 12*a* is closed by the lid body 14.

In the second embodiment, it is possible to adopt an assembly procedure wherein the basket body 22 is so fitted to the lid body 24 as to cover it while the reactor bodies 13 are retained on the side of the lid body 24, as well as the aforementioned assembly procedure wherein the reactor bodies 13 are accommodated at suitable locations.

In each of the aforementioned embodiments, the partitions 12*d* or 24*d* are so formed as to extend across the entire interior of the basket body 12 or 22. However, the partitions 12*d* or 24*d* may be divided into a plurality of portions such that they look like teeth of a comb in a side view, with the notch 12*g* or 24*g* being dispensed with.

The reactor unit of the invention is constructed as described above and thus can be prevented from being deformed due to shrinkage of the mold resin occurring during curing thereof.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A reactor unit comprising:

a basket body which has one open face and which is made of a metal;

a plurality of reactor bodies which are accommodated in the basket body;

a lid body which is made of a metal, which closes the open face of the basket body, and in which outlet holes are formed; and a mold resin which is a curable resin and with which the basket body is completely filled with a coil of each of the reactor bodies having been drawn out from a corresponding one of the outlet holes of the lid body, wherein a partition, extends from an inner face of at least one of the basket body and the lid body, and an entire surface of a leading end of the partition contacts an inner face of the other, when the open face of the basket body is closed by the lid body.

2. The reactor unit according to claim 1, wherein the at least one partition is formed integrally with at least one of the basket body and the lid body.

3. The reactor unit according to claim 1, wherein the at least one partition is so formed as to extend an entire depth of, as well as substantially across an entire width of, the basket body.

4. The reactor unit according to claim 3, wherein an opening through which the mold resin passes is formed in a certain part of the partition.

5. The reactor unit according to claim 4, wherein the opening is formed in the vicinity of the inner face of the lid body.

6. The reactor unit according to claim 5, wherein the opening is a notch in which a wire for a temperature detector disposed in the basket body is located.

7. The reactor unit according to claim 1, wherein there is a gap between the at least one partition and the reactor bodies while the mold resin is interposed therebetween.

8. The reactor unit according to claim 1, wherein there is no gap between the at least one partition and the reactor bodies while the mold resin is interposed therebetween.

9. The reactor unit according to claim 2, wherein the partition is formed integrally with the basket body.

10. The reactor unit according to claim 2, wherein the partition is formed integrally with the lid body.

* * * * *

UNITED STATES PATENT AND TRADEMARK OFFICE

CERTIFICATE OF CORRECTION

PATENT NO. : 7,038,568 B2
APPLICATION NO. : 10/660603
DATED : May 2, 2006
INVENTOR(S) : Kaneko et al.

It is certified that error appears in the above-identified patent and that said Letters Patent is hereby corrected as shown below:

| Column | Line | |
|---|---|---|
| 6 | 19 | After "partition" delete ",". |
| 6 | 22 | After "other" delete ",". |

Signed and Sealed this

Seventh Day of August, 2007

JON W. DUDAS
*Director of the United States Patent and Trademark Office*